US007976232B2

(12) United States Patent
Eoka

(10) Patent No.: US 7,976,232 B2
(45) Date of Patent: Jul. 12, 2011

(54) PRINTER FOR FEEDING A CUT SHEET AND A CONTINUOUS SHEET

(75) Inventor: Kenji Eoka, Sunto-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 745 days.

(21) Appl. No.: 12/023,668

(22) Filed: Jan. 31, 2008

(65) Prior Publication Data

US 2008/0193188 A1 Aug. 14, 2008

Related U.S. Application Data

(60) Provisional application No. 60/889,499, filed on Feb. 12, 2007.

(51) Int. Cl.
*B41J 11/48* (2006.01)

(52) U.S. Cl. ..... 400/608.1; 400/605

(58) Field of Classification Search ..... 400/605, 400/608.1, 608.2
See application file for complete search history.

(56) References Cited

U.S. PATENT DOCUMENTS

| | | | | | |
|---|---|---|---|---|---|
| 4,326,815 | A | * | 4/1982 | Kapp | 400/625 |
| 4,929,104 | A | * | 5/1990 | Yokoi et al. | 400/605 |
| 5,030,024 | A | * | 7/1991 | Seshimo | 400/605 |
| 5,648,808 | A | * | 7/1997 | Yanagi et al. | 347/104 |
| 5,899,613 | A | * | 5/1999 | Koike et al. | 399/384 |
| 5,984,469 | A | * | 11/1999 | Koike et al. | 347/104 |

FOREIGN PATENT DOCUMENTS

| | | |
|---|---|---|
| JP | 07-232461 | 9/1995 |
| JP | 07-314855 | 12/1995 |

* cited by examiner

*Primary Examiner* — Daniel J Colilla
(74) *Attorney, Agent, or Firm* — Turocy & Watson, LLP

(57) ABSTRACT

A sheet guide member is provided on an upstream side of a second pinch roller holder in a sheet transport direction, so that even in a state where a first pinch roller holder is lowered at a time of a continuous sheet mode, a sheet is smoothly sent to a second pinch roller.

7 Claims, 2 Drawing Sheets

PRINTER FOR FEEDING A CUT SHEET AND A CONTINUOUS SHEET

BACKGROUND OF THE INVENTION

1. Field of the Invention

The present invention relates to a printer which can print on both a continuous sheet and a discontinuous sheet.

2. Description of the Related Art

A printer is used which selectively transports a continuous sheet, such as fanfold paper, and a discontinuous sheet, such as a single part sheet or cut sheet, to a printing unit and can perform printing.

As such a printer, there is one in which by user's selecting operation to a release lever, at the time of a single part sheet, a registration roller, a pinch roller and an auxiliary roller are respectively urged to a transport roller, and at the time of a continuous sheet, the registration roller is retracted from a transport path, and at the same time, the press contact forces of the pinch roller and the auxiliary roller to the transport roller are relieved (JP-A-07-232461).

Besides, there is a printer in which in the case where a single part sheet is printed, a switching lever is positioned at a first switching position, and a pinch roller is brought into press contact with a feed roller, and in the case where a continuous sheet is printed, the switching lever is positioned at a second switching position, and the pinch roller is separated from the feed roller in the state where the pinch roller and the feed roller are in press contact with each other, so that the continuous sheet does not slacken (JP-A-07-314855).

BRIEF SUMMARY OF THE INVENTION

It is an object of the present invention to provide a printer which selectively feeds a cut sheet and a continuous sheet and can perform printing.

In an aspect of the present invention, a printer configured to selectively feed a cut sheet and a continuous sheet and to enable printing, includes a platen and a print head disposed to be opposite to each other, a sheet guide surface to guide both the cut sheet and the continuous sheet along an outer peripheral surface of the platen, a paper path switching lever capable of switching a sheet transport path according to the fed cut sheet or the fed continuous sheet, a paper path switching shaft provided to engage with the paper path switching lever, a sheet detection sensor provided near the paper path switching lever and turned ON/OFF according to a position of the paper path switching lever, a first pinch roller which is brought into press contact with an outer peripheral surface portion of the platen on an upstream side of the sheet detection sensor in a sheet transport direction at a time of feeding of the cut sheet, and is, at a time of feeding of the continuous sheet, separated from the outer peripheral surface portion of the platen through the paper path switching shaft and is retracted to an outside of the sheet transport path, a first pinch roller holder configured to support the first pinch roller, a second pinch roller which is brought into press contact with an outer peripheral surface portion of the platen on a downstream side of the sheet detection sensor in the sheet transport direction at the time of feeding of the cut sheet, and is, at the time of feeding of the continuous sheet, brought into press contact with the outer peripheral surface portion of the platen by a press contact force weaker than that at the time of feeding of the cut sheet, and a sheet guide member which is disposed in a pinch roller holder to support the second pinch roller, a tip end of which is positioned upstream of the sheet detection sensor in the sheet transport direction, and guides the continuous sheet to the second pinch roller in a state where the first pinch roller is retracted to the outside of the sheet transport path at the time of feeding of the continuous sheet.

DETAILED DESCRIPTION OF THE INVENTION

Throughout this description, the embodiments and examples shown should be considered as exemplars, rather than limitations on the apparatus and methods of the present invention.

Hereinafter, an embodiment of a printer of the invention will be described in detail with reference to the drawings.

Figure 1:
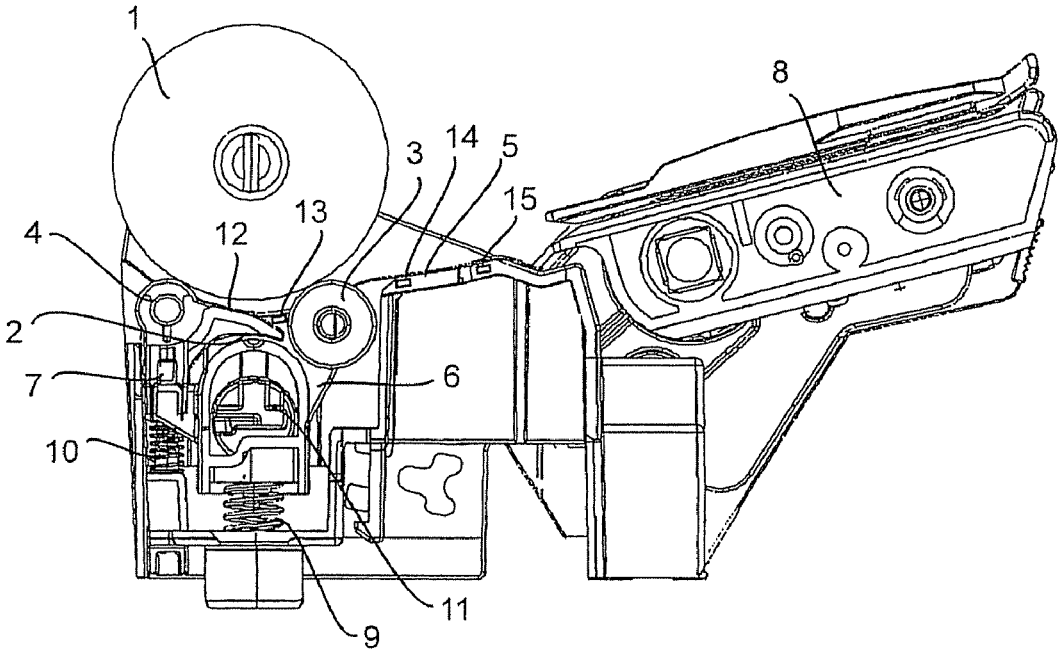
FIG. 1 is a view for explaining the main part of a printer of an embodiment of the invention.

FIG. 1 shows a schematic structure of a main part of a printer which can selectively print on a cut sheet, such as a single part sheet, a folded continuous sheet called fanfold paper, and the like. As shown in FIG. 1, a platen 1 and a print head 2 are disposed to be opposite to each other. The print head 2 is reciprocated in a longitudinal direction (direction perpendicular to the paper plane of the drawing) of the platen 1. Besides, a sheet guide surface 5 is formed to be capable of guiding both the cut sheet and the continuous sheet along the outer peripheral surface of the platen 1. The platen 1 produces a main transport force in a cut sheet mode. The continuous sheet is set on a tractor 8 which produces a main transport force in a continuous sheet mode, and is fed to the sheet guide surface 5. The cut sheet is fed to the sheet guide surface 5 from a sheet cassette (not shown) set in a space between the platen 1 and the tractor 8. Accordingly, both the cut sheet and the continuous sheet are transported from the right to the left in FIG. 1 with respect to the platen 1.

A sheet detection sensor 13 for detecting the presence or absence of a sheet is provided on the sheet guide surface 5.

A leading edge sensor 14 for detecting the leading edge of a transported sheet and a rear edge sensor 15 for detecting the rear edge of the sheet are provided near the sheet guide surface 5.

Below the platen 1, a first pinch roller 3 is provided on an upstream side in a sheet transport direction, a second pinch roller 4 is provided on a downstream side in the sheet transport direction, and they can come in contact with and can be separated from the platen 1.

The first pinch roller 3 is rotation-supported by a first pinch roller holder 6 so that the first pinch roller can come in contact with and can be separated from an outer peripheral surface portion of the platen 1 on the upstream side of the sheet detection sensor 13 in the sheet transport direction. The first pinch roller holder 6 is for supporting the first pinch roller 3, and functions as a pinch roller contact and separation mechanism in the inside of which a press contact spring 9 is incorporated.

Besides, the second pinch roller 4 is rotation-supported by a second pinch roller holder 7 so that the second pinch roller can come in press contact with and can be separated from an outer peripheral surface portion of the platen 1 on the downstream side of the sheet detection sensor 13 in the cut sheet transport direction. The second pinch roller holder 7 is for supporting the second pinch roller 4, and functions as a pinch roller contact and separation mechanism in the inside of which a press contact spring 10 is incorporated.

It is desirable that the spring urging force of the press contact spring 9 for bringing the first pinch roller 3 into press contact with the platen 1 and the spring urging force of the press contact spring 10 for bringing the second pinch roller 4 into press contact with the platen 1 have a relation of 3 to 4:1. This is because at the time of feeding of the continuous sheet, it is necessary to keep the relation that the sheet transport force of the tractor 8 is larger than the sheet transport force of the platen 1.

Besides, the first pinch roller 3 and the second pinch roller 4 press the cut sheet to the platen 1, and nips and transports the cut sheet in cooperation with the platen 1.

A sheet guide member 12 whose tip end is positioned upstream of the sheet detection sensor 13 in the sheet transport direction and has a tongue shape is provided in the second pinch roller holder 7. As described later, the sheet guide member 12 is for guiding the continuous sheet to the second pinch roller 4 in a state where the first pinch roller 3 is retracted to the outside of the sheet transport path at the time of feeding of the continuous sheet. It is desirable that the second pinch roller holder 7 is made of, for example, ABS resin, and is formed integrally with the sheet guide member 12. In this embodiment, the sheet guide member 12 is formed so that its tip end is positioned upstream, in the sheet transport direction, of the left outer peripheral end, in FIG. 1, of the first pinch roller 3 brought into press contact with the platen 1. Further, it is desirable that the tip end of the sheet guide member 12 is formed so that even if the sheet nipped between the first pinch roller 3 and the platen 1 waves, the tip end does not come in contact with the sheet.

When the first pinch roller holder 6 is pressed downward in the drawing (opposite side to the platen 1), the first pinch roller 3 is pressed to the platen 1 by the press contact spring 9 incorporated in the pinch roller contact and separation mechanism. Besides, when the second pinch roller holder 7 is pressed downward in the drawing (opposite side to the platen 1), the second pinch roller 4 is pressed to the platen 1 by the press contact spring 10 incorporated in the pinch roller contact and separation mechanism.

Besides, a paper path switching lever (not shown) to select between transport paths (paper paths) of a cut sheet and a continuous sheet is provided. The tip end side of the paper path switching lever is made to be easily gripped so that the user can operate it. A paper path switching shaft 11 is disposed near the paper path switching lever. Gears are attached to one end side of the paper path switching lever and the paper path switching shaft 11, respectively. Both are constructed so as to be rotated in synchronization with each other by the engagement of these gears. The section of a part of the paper path switching shaft 11 is formed into a D shape. A part of the first pinch roller holder 6 is in contact with the D-shaped part of the paper path switching shaft 11. Thus, when the paper path switching shaft 11 is rotated by the operation of the paper path switching lever, the first pinch roller holder 6 is pressed downward, that is, in the direction of separating from the platen 1 by the D-shaped part of the paper path switching shaft 11.

Next, the operation will be described.

(Case where Cut Sheet is Printed)

Figure 2:
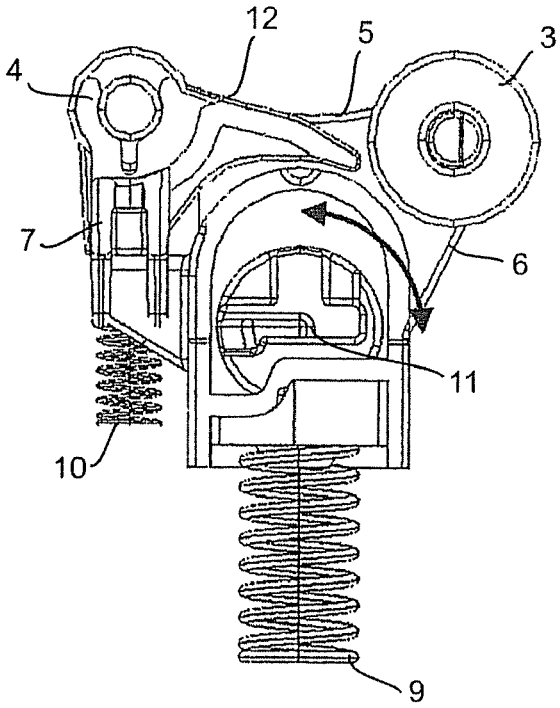
FIG. 2 is a view for explaining a movement in a mode of printing on a cut sheet.

FIG. 2 is a view for explaining a movement in a mode of printing on a cut sheet. In the case where printing is performed on the cut sheet, the platen 1 is forwardly rotated in a state where it is in press contact with the first pinch roller 3 and the second pinch roller 4. By this, the first pinch roller 3 and the second pinch roller 4 are driven and are positively rotated (reverse direction rotation to the platen 1).

The cut sheet sent on the sheet guide surface 5 is smoothly inserted between the first pinch roller 3 and the platen 1, and is sent by the platen 1 and the first pinch roller 3 until the tip end thereof is detected by the sheet detection sensor 13, and the cut sheet is set at a specified position.

Here, since the sheet detection sensor 13 is disposed at the downstream side of the first pinch roller 3 in the sheet transport direction, in case the cut sheet is not set straight with respect to the first pinch roller 3, the sheet is not detected, and accordingly, there does not occur a state in which the cut sheet is set to be inclined with respect to the first pinch roller 3.

The cut sheet set at the specified position is transported on the sheet guide surface 5 by the platen 1 and the first pinch roller 3 and the second pinch roller 4, and is sent to a printing unit and is printed.

As stated above, at the time of the cut sheet mode, the state is produced in which each of the first pinch roller 3 and the second pinch roller 4 is pressed to the platen 1, the slack of the sheet is eliminated, and the sheet is made to be easily wound around the platen 1.

Incidentally, at this time, in the state where the rear edge part of the cut sheet is positioned between the first pinch roller 3 and the second pinch roller 4, when the platen 1 is rotated in the reverse direction to the forward rotation in order to reversely send the sheet, the first pinch roller 3 and the second pinch roller 4 are reversely rotated. At the time of the reverse sending, when the rear edge part of the cut sheet reaches the position of the sheet rear edge sensor, further reverse rotation is prevented.

(Case where Continuous Sheet is Printed)

Figure 3:
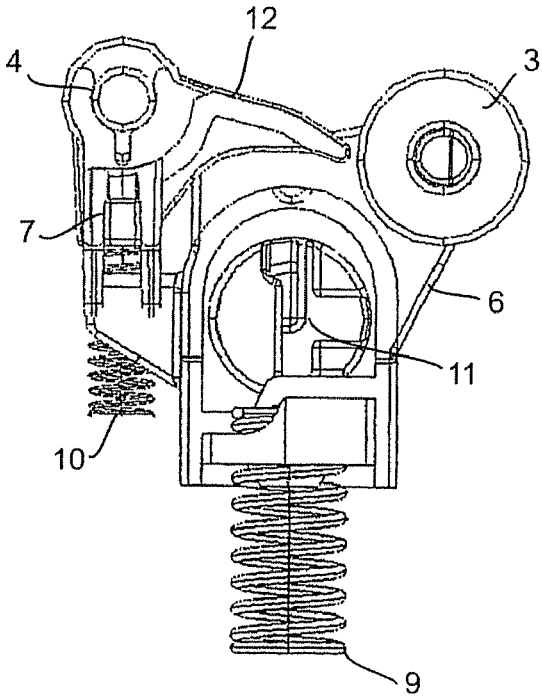
FIG. 3 is a view for explaining a movement in a mode of printing on a continuous sheet.

FIG. 3 is a view for explaining a movement in a mode of printing on a continuous sheet.

In the case where printing is performed on the continuous sheet, the position of the paper path switching lever is set to a continuous sheet mode. In accordance with the operation of the paper path switching lever, since the gear of the paper path switching lever and the gear of the paper path switching shaft 11 are engaged with each other, the paper path switching shaft 11 is rotated by ¼ turn. Then, the first pinch roller holder 6 is pressed downward by the D shape of the paper path switching shaft 11. The first pinch roller 3 supported by the first pinch roller holder 6 is separated from the platen 1, and is retracted to the outside of the sheet transport path.

On the other hand, the second pinch roller holder 7 is put in a free state. The second pinch roller 4 supported by the second pinch roller holder 7 comes in press contact with the platen 1 by a weak force caused by the urging force of the press contact spring 10. As stated above, in the case of the continuous sheet mode, the state is produced in which only the roller of the second pinch roller 4 is pressed to the platen 1, the slack of the sheet is eliminated, and the sheet is made to be easily wound around the platen 1.

Next, in the state, the tractor 8 is used to send the continuous sheet along the sheet guide surface 5 until its leading edge is detected by the sheet detection sensor 13, and the continuous sheet is set at a specified position. After the setting, the continuous sheet is transported on the sheet guide surface 5, is supplied to the printing unit and is printed.

At the time of feeding of the continuous sheet, the first pinch roller 3 is retracted to the outside of the sheet transport path, and the continuous sheet is sent to the second pinch roller 4 by the sheet guide member 12 disposed in the second pinch roller holder 7.

Incidentally, when the platen 1 is rotated in the direction reverse to the forward rotation in order to reversely send the continuous sheet, the second pinch roller 4 is reversely rotated. At the time of the reverse sending, when the rear edge part of the sheet reaches the sheet rear edge sensor, further reverse rotation is prevented.

According to the invention, since the sheet guide member 12 positioned on the upstream side in the sheet transport direction is provided in the second pinch roller holder 7, even in the case of the continuous sheet mode, the slack of the sheet can be suppressed, and the print quality can be improved. Besides, when perforations of a multi-folded sheet pass, since a clearance between the platen 1 and the second pinch roller holder 7 can be changed, a jam hardly occurs.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A printer configured to selectively feed a cut sheet and a continuous sheet and to enable printing, comprising:

a platen and a print head disposed to be opposite to each other;

a sheet guide surface to guide both the cut sheet and the continuous sheet along an outer peripheral surface of the platen;

a paper path switching shaft capable of switching a sheet transport path according to the fed cut sheet of the fed continuous sheet by rotating;

a sheet detection sensor;

a first pinch roller which is brought into press contact with an outer peripheral surface portion of the platen on an upstream side of the sheet detection sensor in a sheet transport direction at a time of feeding of the cut sheet, and is, at a time of feeding of the continuous sheet, separated from the outer peripheral surface portion of the platen through the paper path switching shaft and is retracted to an outside of the sheet transport path;

a first pinch roller, wherein the rotation of the paper path switching shaft causes a linear translation of the first pinch roller holder, holder configured to support the first pinch roller;

a second pinch roller which is brought into press contact with an outer peripheral surface portion of the platen on a downstream side of the sheet detection sensor in a sheet transport direction at the time of feeding of the cut sheet, and is, at the time of feeding of the continuous sheet, brought into press contact with the outer peripheral surface portion of the platen by a press contact force weaker than that at the time of feeding of the cut sheet; and a sheet guide member which is disposed in a second pinch roller holder to support the second pinch roller, a tip end of which is positioned upstream of the sheet detection sensor in the sheet transport direction, and is capable of guiding the continuous sheet to the second pinch roller even in a state where the first pinch roller is retracted to the outside of the sheet transport path at the time of feeding of the continuous sheet.

2. The printer according to claim 1, wherein the sheet guide member is formed integrally with the pinch roller holder.

3. The printer according to claim 1, wherein a material of the sheet guide member is an ABS resin.

4. The printer according to claim 1, wherein a sheet transport force of a tractor is larger than a sheet transport force of the platen.

5. The printer according to claim 1, further comprising a sheet leading edge sensor to detect a leading edge of a sheet, and a sheet rear edge sensor to detect a rear edge of the sheet.

6. The printer according to claim 1, further comprising a first spring providing a first spring urging force for bringing the first pinch roller into press contact with the platen and a second spring providing a second spring urging force for bringing the second pinch roller into press contact with the platen.

7. The printer according to claim 6, wherein the first spring urging force and the second spring urging force have a relation of 3 to 4:1.

* * * * *